US010495427B2

(12) United States Patent
Thielen et al.

(10) Patent No.: US 10,495,427 B2
(45) Date of Patent: Dec. 3, 2019

(54) SUBSONIC EXPANDING BULLET

(71) Applicant: HORNADY MANUFACTURING COMPANY, Grand Island, NE (US)

(72) Inventors: Joseph Thielen, Grand Island, NE (US); Jayden Quinlan, Grand Island, NE (US); Ryan Damman, Grand Island, NE (US)

(73) Assignee: Hornady Manufacturing Company, Grand Island, NE (US)

( * ) Notice: Subject to any disclaimer, the term of this patent is extended or adjusted under 35 U.S.C. 154(b) by 0 days.

(21) Appl. No.: 16/373,162

(22) Filed: Apr. 2, 2019

(65) Prior Publication Data

US 2019/0316888 A1 Oct. 17, 2019

Related U.S. Application Data

(60) Provisional application No. 62/656,046, filed on Apr. 11, 2018.

(51) Int. Cl.

| | |
|---|---|
| ***F42B 12/00*** | (2006.01) |
| ***F42B 12/34*** | (2006.01) |
| ***F42B 12/74*** | (2006.01) |
| ***F42B 12/78*** | (2006.01) |

(52) U.S. Cl.
CPC ..... *F42B 12/34* (2013.01); *F42B 12/74* (2013.01); *F42B 12/78* (2013.01)

(58) Field of Classification Search
CPC ..... F42B 12/34
See application file for complete search history.

(56) References Cited

U.S. PATENT DOCUMENTS

| | | | | | |
|---|---|---|---|---|---|
| 1,135,357 | A * | 4/1915 | Clyne | F42B 12/34 | 102/508 |
| 1,322,662 | A * | 11/1919 | Watson | F42B 12/34 | 102/510 |
| 1,493,614 | A * | 5/1924 | Dickerman | F42B 12/34 | 102/510 |
| 1,556,160 | A * | 10/1925 | Riggs | F42B 12/34 | 102/510 |
| 3,143,966 | A * | 8/1964 | Burns, Jr. | F42B 12/34 | 102/507 |
| 4,044,685 | A * | 8/1977 | Avcin | F42B 12/34 | 102/508 |
| 5,811,723 | A * | 9/1998 | Stone | F42B 12/34 | 102/509 |
| 6,546,875 | B2 * | 4/2003 | Vaughn | F42B 12/34 | 102/507 |
| 8,161,885 | B1 | 4/2012 | Emary | | |
| 8,413,587 | B2 | 4/2013 | Emary | | |
| 10,041,773 | B2 * | 8/2018 | Peterson | F42B 12/74 | |
| 2012/0111220 | A1 * | 5/2012 | King | F42B 12/34 | 102/509 |
| 2018/0245896 | A1 * | 8/2018 | Burczynski | F42B 10/38 | |

FOREIGN PATENT DOCUMENTS

| | | | | |
|---|---|---|---|---|
| DE | 4130455 | A1 * | 3/1993 | F42B 12/34 |

* cited by examiner

*Primary Examiner* — Gabriel J. Klein
(74) *Attorney, Agent, or Firm* — McHale & Slavin, P.A.

(57) ABSTRACT

A bullet for expansion at subsonic speed of impact with a target. The bullet includes a pocket in its interior. A tip insert has a stem portion extending into the pocket. The stem portion and the pocket each have a portion with a cross sectional area that decreases from a forward end to a trailing end.

17 Claims, 9 Drawing Sheets

SUBSONIC EXPANDING BULLET

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/656,046, entitled "SUBSONIC EXPANDING BULLET", filed Apr. 11, 2018. The contents of the above referenced application are incorporated herein by reference in its entirety.

FIELD OF THE INVENTION

The invention generally relates to bullets, and more specifically, to a bullet with improved expansion upon impact at subsonic speed.

BACKGROUND OF THE INVENTION

Bullets are well known in the art. A bullet is the projectile that is discharged from the barrel of a gun. The bullet is driven into the rifled portion of a barrel by high pressure gas generated from the burning of a propellant (gun powder), which is typically ignited by a primer, as is well known in the art. The term "bullet" is often used to incorrectly refer to a complete ammunition cartridge. A cartridge, as properly used, includes a case (or casing) that holds the propellant in an interior chamber. Propellant is often referred to as an explosive, but it is not technically an explosive since, if ignited unconfined, it simply burns. The case will have a primer pocket that holds a primer which is used to ignite the propellant by flame going through the flash hole. There are two types of primers and primer pockets, Berdan and Boxer. The most common primer used in the U.S. is the Boxer primer. It allows for using a pre-fired case for reloading. The bullet is seated in the throat or open end of the case and held in place by friction, and perhaps crimping of the open end of the case.

As simple as shooting a bullet may sound, there is a large body of science regarding what is referred to as ballistics, which can be broken down into three main categories: internal ballistics, external ballistics, and terminal ballistics. Internal ballistics concerns itself with what happens during propellant burning in the barrel until the bullet is discharged from the barrel. External ballistics is the science regarding the flight of the bullet. Terminal ballistics is the study of how the bullet behaves when it strikes the target, including the transfer of kinetic energy of the bullet to the target.

In terminal ballistics, some bullets have been designed to mushroom (or expand) when contacting and/or traveling within the target, while some bullets are designed to resist such expansion. Hunting and defense bullets are typically designed to expand. One important factor in expansion is bullet speed at impact, i.e., its kinetic energy. Kinetic energy is related to bullet speed in accordance with the square of its speed. Thus, a bullet having half the speed of another bullet of the same mass has one quarter of its kinetic energy.

There are two issues regarding speed. The industry uses the term velocity in this regard, rather than the term speed. Velocity is a vector quantity needing both magnitude and direction. Speed is not a vector quantity, and thus only includes magnitude. Throughout this application, the term "speed" will be used contrary to the industry practice. Many cartridges are designed to provide a low speed bullet, while many are designed to provide a high speed bullet. Pistol bullets tend to be low speed. Centerfire type rifle bullets tend to be high speed, although slower than normal speed ammunition has recently entered the market. In one example, high speed bullets are designed to travel their entire course at supersonic speed. However, during long range shooting, many high speed bullets will have a decrease in speed, and subsequently change from supersonic speed to subsonic speed. Some writers have implicated the transition from supersonic to subsonic as problematic for both accuracy and precision, hence a trend to use bullets having subsonic speeds throughout their course. In general, subsonic bullets also have less initial energy associated with their internal ballistics, and thus exhibit less recoil to the shooter. Additionally, shooting bullets at subsonic speed should result in less barrel wear, extending the life of the firearm. Bullet speed is determined by many factors, including primer, amount and type of powder, rifling twist rate, bullet weight, and barrel length.

Today's rifle bullets, particularly hunting and defense bullets, have been designed for expansion in the target at supersonic speed. Depending on temperature, humidity and barometric pressure, the speed of sound in air is about 1,125 feet/second, which for purposes of this application will be the speed of sound. Below this speed is subsonic and above is supersonic.

Pistol bullets designed for expansion are typically of a hollow point construction to obtain expansion. Rifle bullets that are supersonic upon exit from the barrel can be of either a hollow point construction, often used for match ammunition, or can have a pointed tip, such as provided by a polymeric tip insert at its leading end to help initiate expansion of the bullet. Once expansion is initiated, the bullet will continue its expansion, including expansion of the core. A modern rifle bullet is typically a jacketed bullet with a soft dense metallic core, typically a lead alloy core, while the jacket is of a copper alloy. It is desirable for most such bullets to retain as much of their original mass as practical during target penetration. This can be accomplished by, e.g., bonding the core to the jacket and/or mechanical means, such as an inwardly extending rib on the jacket extending into a groove in the core.

A hollow point bullet, often simply referred to as a hollow point, has a central cavity or opening at the nose of the bullet which facilitates the hollow forward end flaring outward upon impact to create a broader profile. This is more disruptive of tissue, providing increased effectiveness. However, hollow point bullets have certain disadvantages. The amount by which the bullet expands is important, with under-expansion and over-expansion limiting effectiveness. If the bullet does not adequately expand, then it has less disruptive effect, leading to reduced stopping power and possible over penetration of the target, endangering bystanders, or at least limiting effectiveness by failing to deliver some of the bullet's energy to the target as impact. An over-expanded round delivers more impact to the target because of higher deceleration, but has limited penetration. This can also diminish the intended effectiveness against targets.

Moreover, if a criminal attacker is wearing heavy clothing, such as denim or leather, the clothing material may clog the hollow point, preventing or substantially reducing expansion, and thus reducing impact (energy transfer) and effectiveness. Another problem with conventional hollow point bullets is that an off-axis impact on hard material, such as sheet metal or glass, can tend to cause the hollow point's leading edge to bend, closing it up and preventing or impeding expansion upon eventual impact with the ultimate target.

Some bullets have hollow points formed in the bullet body (typically formed of a lead alloy with a copper alloy jacket) with the hollow cavity filled with an element of a different material. Rifle bullets may have a hollow cavity filled with a pointed tip element to provide an aerodynamic profile, and which facilitates expansion upon impact at high speed. Certain pistol bullets employ a round plastic ball that partially fills a bullet's cavity, preventing clogging with clothing material and facilitating expansion. While these variations provide some benefits, there remains a need to generate more effective and controlled expansion of bullets. A particular concern is that, while high-speed rifle bullets readily expand upon impact, lower speed rounds expand less reliably. What works to effect expansion of a high speed bullet, may not work as intended with a slow speed bullet and vice versa. Expansion is a process, not an event.

Achieving expansion of a non hollow point bullet at subsonic speeds has been a challenge to the prior art. The present invention overcomes this deficiency.

DESCRIPTION OF THE PRIOR ART

As shown in U.S. Pat. No. 8,161,885 to Emary, hollow point bullets are found to perform more effectively when the cavity is filled with an elastomeric nose element. The elastomeric nose element allows the use of harder lead alloy bullets than are normally considered suitable for expanding pistol bullets, which typically use soft pure lead in the core. The elastomer-filled cavity bullets allow the use of harder alloys because the elastomeric nose insert provides a force to expand the bullet. Along with being unusually effective, the hard lead alloy bullets also increase consistency and post-barrier performance in these bullets. A bullet, or a cartridge containing a bullet, has an elongated body with a forward end and an opposed rear end. The body has an intermediate cylindrical portion between the rear and forward ends, and the front end of the body defines a cavity. A resilient nose element is received in the cavity. The nose element may be an elastomer and may be a cylindrical body. The cavity may be a cylindrical bore, and the nose element may be closely encompassed within the bore. The forward end of the nose element may be flat and may be flush with the forward end of the body.

U.S. Pat. No. 8,413,587, also to Emary, discloses a cartridge containing a bullet having an elongated body with a forward end and an opposed rear end. The body has an intermediate cylindrical portion between the rear and forward ends, and the front end of the body defines a cavity. A resilient nose element is received in the cavity. The nose element may be an elastomer and may be a cylindrical body. The cavity may be a cylindrical bore, and the nose element may be closely encompassed within the bore. The forward end of the nose element may be flat and may be flush with the forward end of the body.

SUMMARY OF THE INVENTION

The present invention provides a bullet with improved terminal ballistic performance at subsonic speed. The bullet includes a tip insert positioned in a pocket that has corresponding predetermined shapes to induce expansion of the bullet core portion to provide a controlled expansion of the bullet upon impact.

Accordingly, it is a primary objective of the present invention to provide a bullet with a tip insert positioned in a pocket in the bullet core that has corresponding shapes to induce expansion of the bullet core portion that is rearward of the forward end of the bullet.

It is a further objective of the present invention to provide a bullet with a tip insert having a rear portion section with a cross sectional area that decreases in size from front to rear forming a wedge.

It is yet another objective of the present invention to provide a bullet with a tip insert with a rear portion having decreasing size that is generally conically shaped.

It is a still further objective of the invention to provide a bullet with a tip insert that has a rear portion rearward of the decreasing size portion which is movably received in a portion of a pocket in the bullet core.

Other objectives and advantages of this invention will become apparent from the following description taken in conjunction with any accompanying drawings wherein are set forth, by way of illustration and example, certain embodiments of this invention. The drawings contained herein constitute a part of this specification, include exemplary embodiments of the present invention, and illustrate various objects and features thereof.

DETAILED DESCRIPTION OF THE INVENTION

Figure 1:
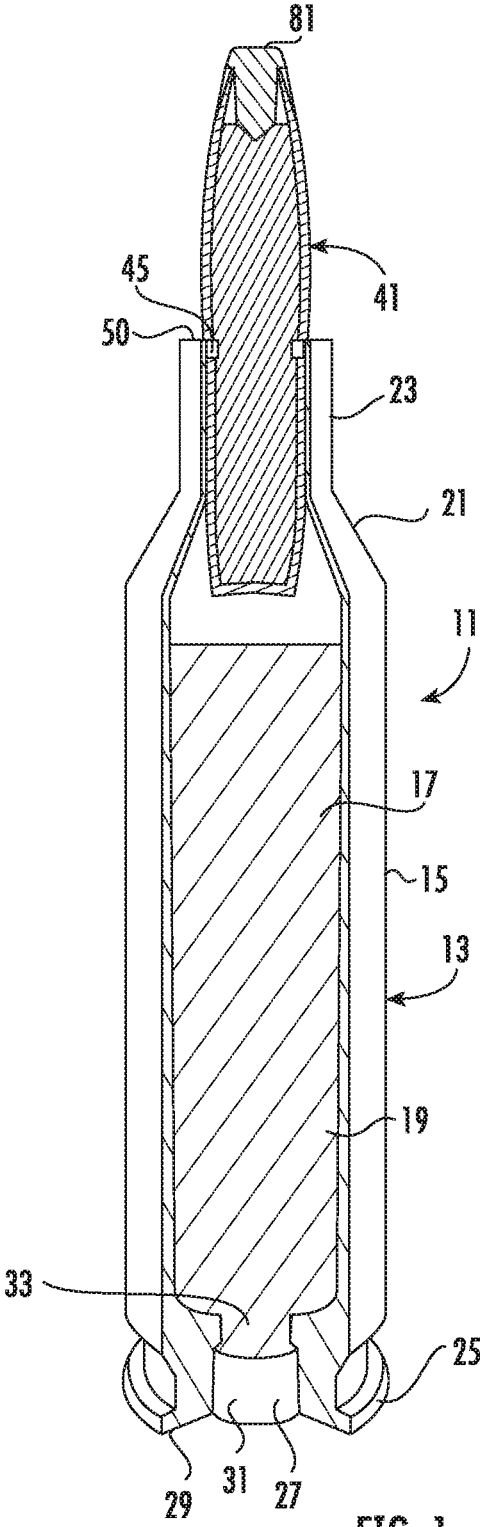
FIG. 1 is a side view, partially in section, of a cartridge of the present invention.

FIG. 1 illustrates a firearm cartridge, designated generally 11, having a case (often also called a casing) 13 with a sidewall 15 defining an interior chamber 17 for holding propellant 19. While a necked down case 13 is illustrated, any suitable case can be used. The illustrated case 13 includes a shoulder 21 and a neck 23. The case 13 includes a base 25 having a primer pocket 27 opening onto the bottom 29 thereof. A primer 31 is positioned within the primer pocket 27 and has the ignition end thereof exposed to the flash hole 33, which provides a primer flame a path between the primer pocket 27 and the interior 17, whereby the flame from the primer 31, when initiated by the firing pin of a firearm (not shown) striking the primer 31, passes through the flash hole 33 and ignites the propellant 19. While the primer 31 and flash hole 33 are shown as a Boxer style primer, any suitable primer arrangement can be used. A bullet 41 is seated in the neck 23 of the case 13 and is held in place, at least partially, by friction. A cannelure 45 can be provided on the exterior surface of the bullet 41, in which case the free end of the neck 23 can be crimped and extend into the cannelure 45, as is known in the art, for additional securement of the bullet in the case 13. Many types of cases 13 are known in the art, and include the necked down type shown, straight wall, belted, rimmed, and rimless etc. The present invention is not limited in use to a particular type of case 13. The bullet 41 has its forward end portion (also tip or nose) 49 extending beyond the open end 50 of the neck 23 as is known in the art. A circumferential inwardly extending rib 52 can be provided inside the jacket 51 (described below), as known in the art, to help prevent separation of the core 55 from the jacket 51 during expansion of the bullet upon impact with a target. It is to be understood that the bullet 41 could be used in a muzzle-loader that does not use a case 13 without departing from the scope of the invention.

The bullet 41 is shown as a jacketed bullet. It has a jacket 51 that can be formed of a soft metal, such as a copper alloy, and can have the metal exposed on the exterior or can be coated with a polymeric coating as is known in the art. As used herein, the term "metal" can include both substantially pure metal and a metal alloy. The jacket 51 is preferably a copper alloy. The bullet 41 has a core 55 which is typically of a lead alloy or other dense metal. As shown, the cannelure 45 is a groove formed in the jacket 51, having a portion 57 of the jacket 51 defining the cannelure extending into the core 55, locking the jacket 51 to the core 55. It is to be understood that the core 55 and jacket 51 can be a monolithic construction. In such a monolithic integral construction, the core portion and the jacket portion are made of the same material. Such a bullet is provided by Hornady, and sold under the brand name GMX. A different metal or core material, such as a lead alloy, can be used for the core 55. A lead alloy core jacketed bullet is the preferred embodiment of the present invention. The manufacture of a jacketed bullet and its component materials are well known in the art.

Figure 2:
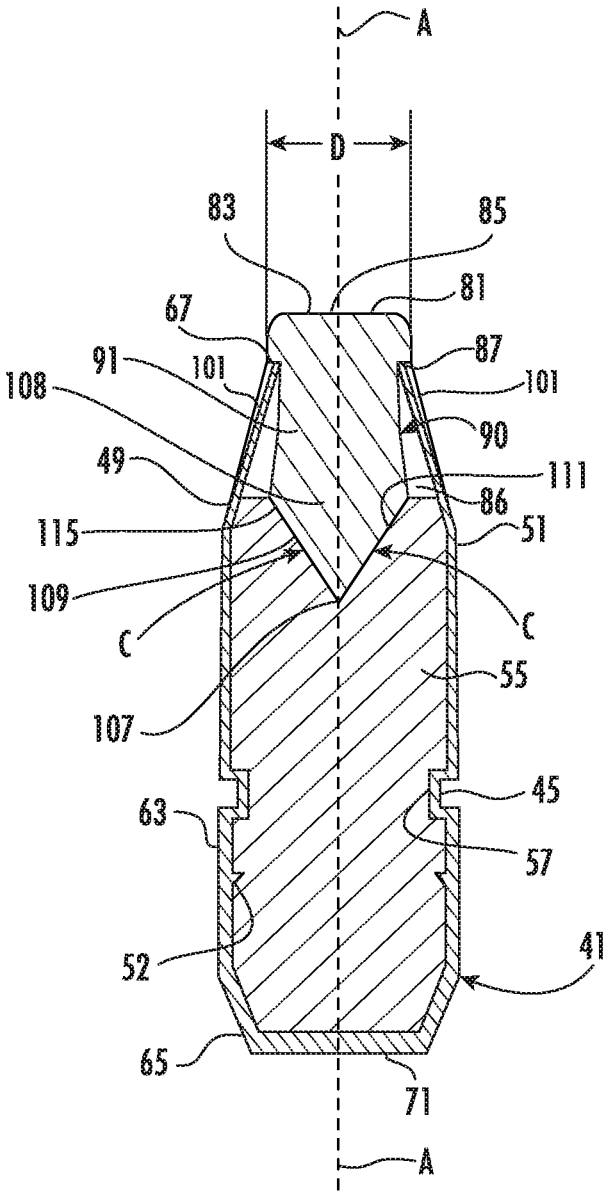
FIG. 2 is an enlarged sectional side view of the bullet of FIG. 1, showing internal details of the bullet.

The bullet 41, as seen in FIG. 2, can be divided into three portions. The tip or nose portion 49, the body portion 63, and the tail portion 65. The nose portion 49 will be contoured to provide streamlining or aerodynamic efficiency. Such a contour can be a secant ogive contour, a spire point, or other contour that provides an increasing diameter from the forward end or meplat 67 of the forward end or nose portion 49 to the body portion 63. The body portion 63 will be generally cylindrical on its exterior surface, except for perhaps one or more cannelures 45 therein. The body portion 63 is the portion of the bullet 41 that will engage the surface defining the bore of the barrel, notably the rifling including the lands and grooves as is known in the art. The tail portion 65 of the bullet 41 can be any suitable shape, such as a boat tail or a flat bottom. In the case of a flat bottom, the tail portion 65 would be the flat bottom, and perhaps the transition contour between the body section 63 and the bottom wall 71. Bullets of the aforementioned types are well known in the art.

Figure 3:
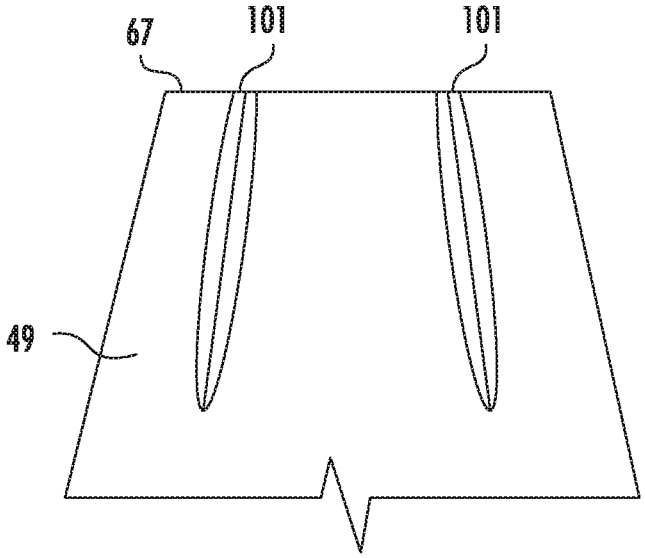
FIG. 3 is an enlarged fragmentary view of the tip end of the bullet to show details of the skives.
Figure 9:
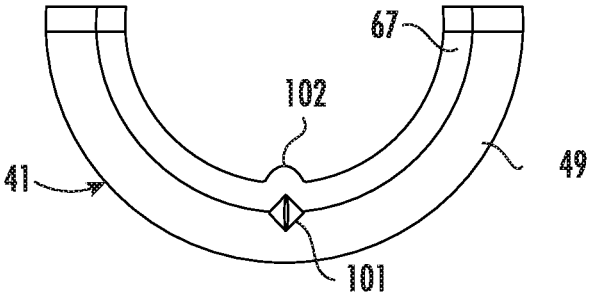
FIG. 9 is a fragmentary end view of the bullet of both FIGS. 1 and 4, showing details of the tip end skives.

The bullet 41 includes a tip insert 81 that is at least mostly contained within the bullet 41, notably the jacket 51, having a forward end or nose tip portion 83 that is preferably at least partially exposed extending forwardly of the meplat 67. The tip portion 83 has a forward face 85 that, on a majority of its surface, is blunt. The tip portion 83 forms an anvil for striking the target and initiating contact deceleration. The forward face 85 is preferably blunt as described below. This means that the face 85 could be slightly contoured, for example, slightly rounded or slightly pointed and convex or concave. The tip portion 83 has a rearwardly facing ledge 87 that is adjacent to the meplat 67 of the jacket 51 and can be in engagement therewith to provide an abutting surface for movement of the tip portion 83 into the hollow forward end of the jacket 51 during bullet manufacture. The hollow forward end forms a cup 86 in the nose portion 49 that opens onto the meplat 67 of the forward end portion 49. As seen in FIG. 2, the tip insert 81 includes a stem portion 90 extending rearwardly of the tip 83. The stem 90 has a forward portion 91 that is rearward of the tip portion 83 and rests inside the cup 86 of the jacket 51. The exterior surface of this forward portion 91 can engage the inside surface of the forward end of the jacket forward end portion 49, or can be slightly spaced therefrom, say for example, up to about 0.030 inches. Such a spacing provides room for the inside surfaces of the skives 101 that are formed in a portion of the nose portion 49 and spaced circumferentially about the forward end portion 49 as seen in FIG. 3. The skives 101 are generally V-shaped in transverse cross-section (FIG. 9) along the length thereof and extend inwardly from the outer surface of the forward end portion 49, and at their deepest are on the order of between about 0.005 inches and about 0.020 inches deep, and at their widest, adjacent the meplat 67, are on the order of between about 0.020 inches and about 0.040 inches. The skives 101 extend generally longitudinally of the forward end portion 49. The length of the skives 101 is on the order of between about ½ and about 1½ times the diameter of the body section 63 (bore diameter). In a preferred embodiment, the skives 101 are positioned circumferentially about the nose portion 49, substantially equally spaced and on the order of 4 to 8 in number. In a preferred embodiment, the skives 101 are press or cold formed, not machined, and open onto the meplat 67. When a skive 101 is press formed, a rib 102 results on the inside of the jacket 51 and generally corresponds in size and shape to the size and shape of the skive 101, but will be larger due to the thickness of the material forming the jacket. Preferably, the ribs 102 will engage the exterior of a portion of the tip insert 81 to help hold the tip insert in place after insertion into the interior of the bullet 41. The tip insert 81 forward portion 91 extends into the bullet 41 at the nose portion 49 from the tip portion 83 approximately ¼ to about ¾ the diameter of the body section 63, exclusive of the cannelure 45, (the bore diameter) and has a transverse cross sectional shape similar to the interior shape of the forward end portion 49 adjacent thereto.

The stem 90 has a rear portion 108, rearward of the forward portion 91, which includes a trailing or terminal end portion 109. The terminal end portion 109 extends into the jacket 51 from the forward portion 91 toward and into the core 55. It is received in a pocket 111 in the core 55. The pocket 111 opens into the rear end of the cup 86. The size and shape of the pocket 111 and the exterior surface of the trailing end portion 109 are similar, and preferably at least a majority of the exterior surface of the end portion 109 is in engagement with the surface defining the pocket 111. From its beginning at the forward end or leading edge 115 of the rear portion 108 to the free end 107, the transverse cross-sectional size/area of the trailing end portion 109 decreases. This can be accomplished by shaping the end portion 109 as a cone, pyramid or other suitable shape. The included angle C opens forwardly and is in the range of between about 15° and about 45°, and preferably in the range of between about 25° and about 35°. The pocket 111 and the trailing end portion 109 thus diverge in shape in a forward direction. In a preferred embodiment, the end portion 109 is conical, i.e., in the shape of a cone or a cone portion having a generally circular transverse, cross-sectional shape. Preferably, at least a portion of the end portion 109 is in the nose portion 49. The free end 107 of the end portion 109 can be pointed or contoured, such as rounded. The major cross-sectional dimension of the end portion 109 at the leading edge 115 is on the order of about 70% or more of the inside diameter of the jacket 51 at the locus of the leading edge 115. The tip insert 81 is preferably made of a polymeric material, including plastic and elastomers having a hardness in the range of between about 60 and about 95 Shore A as measured by a Durometer test. The tip insert 81 can be held on the bullet 41 by friction and/or adhesive.

FIGS. 4-8 illustrate a second embodiment of the present invention. Parts similar to the above described bullet parts will use the same numbers as above.

Figure 4:
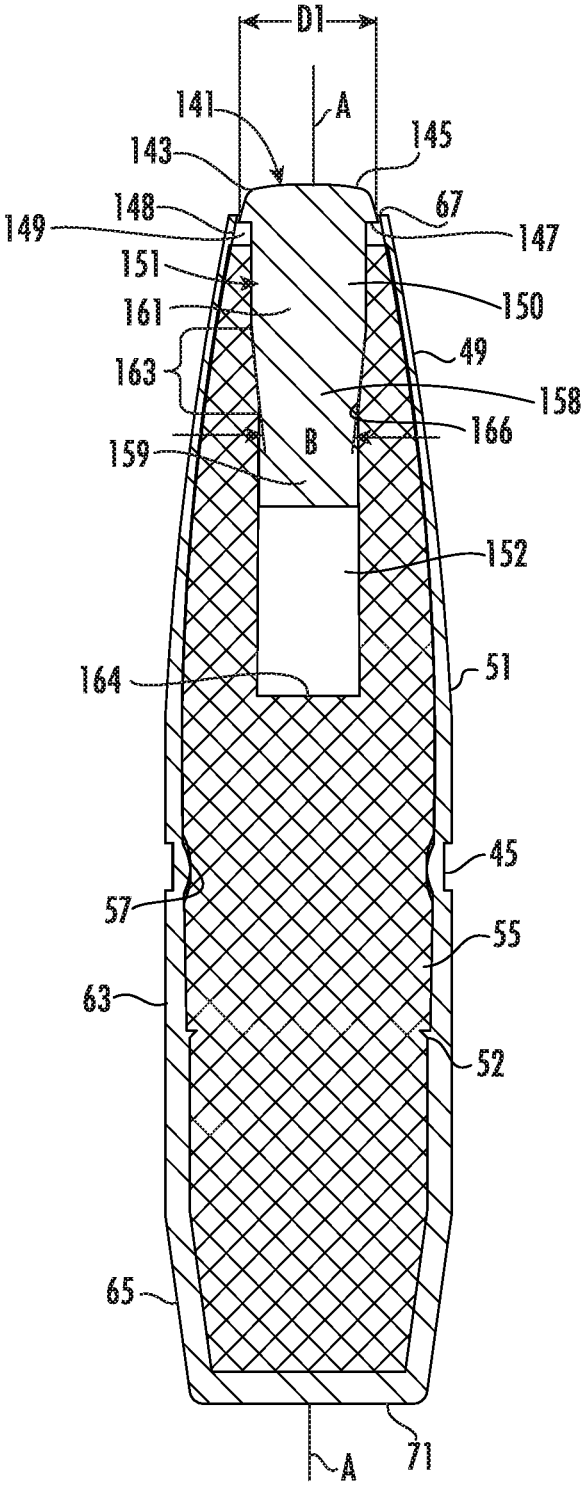
FIG. 4 is a sectional side view of a second embodiment of the present invention.
Figure 5:
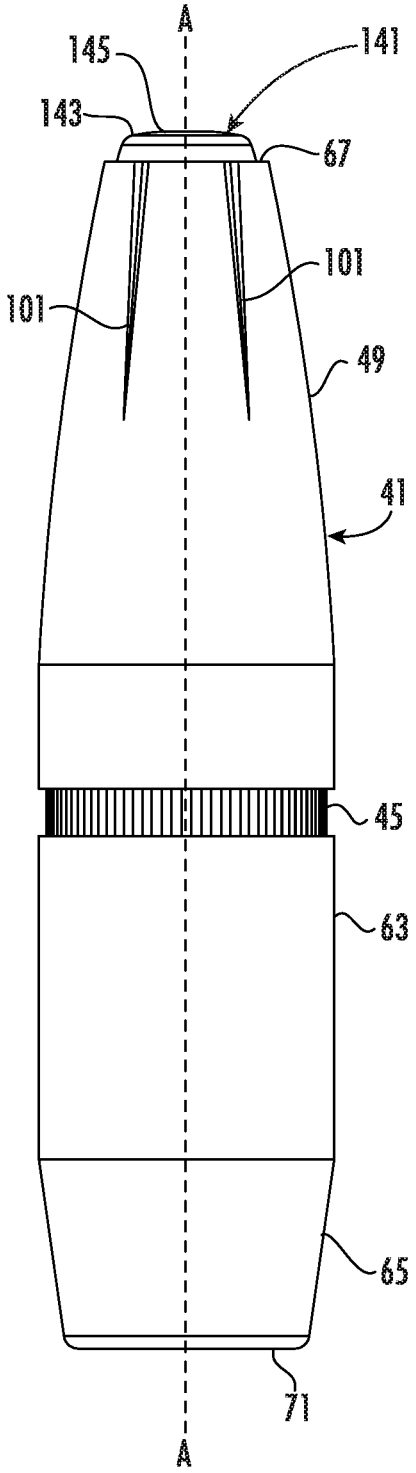
FIG. 5 is a side view of the bullet shown in FIG. 4.
Figure 6:
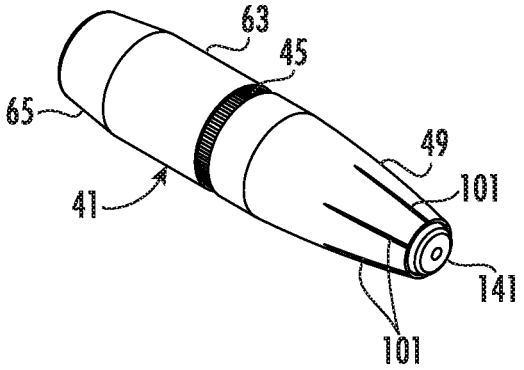
FIG. 6 is a perspective view of the bullet of FIG. 4.
Figure 7:
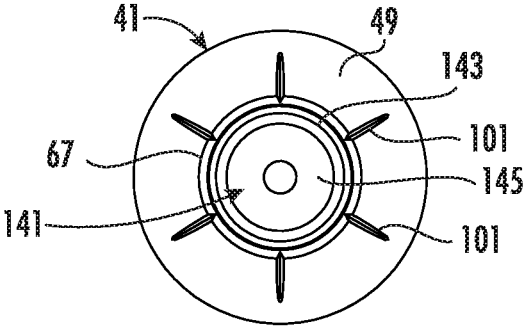
FIG. 7 is an end view of the bullet of FIG. 4, as seen from the tip end of the bullet.
Figure 8:
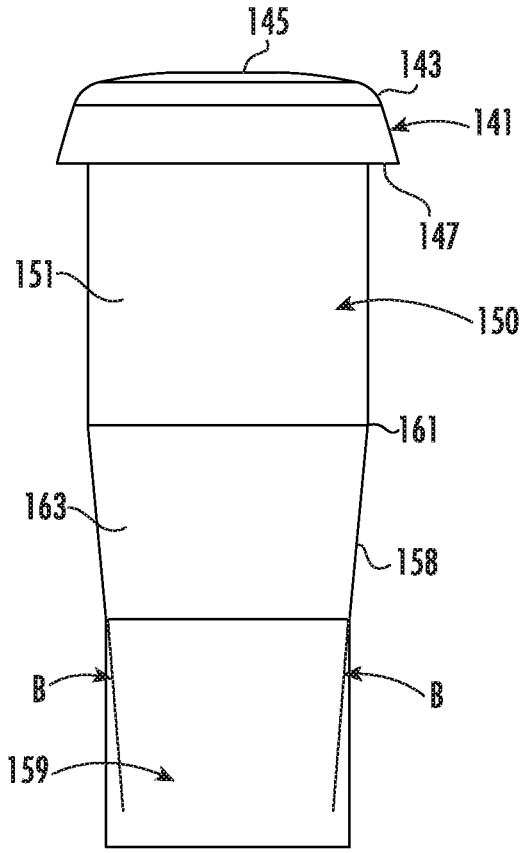
FIG. 8 is an enlarged side view of the tip insert used in the bullet of FIG. 4.
Figure 11:
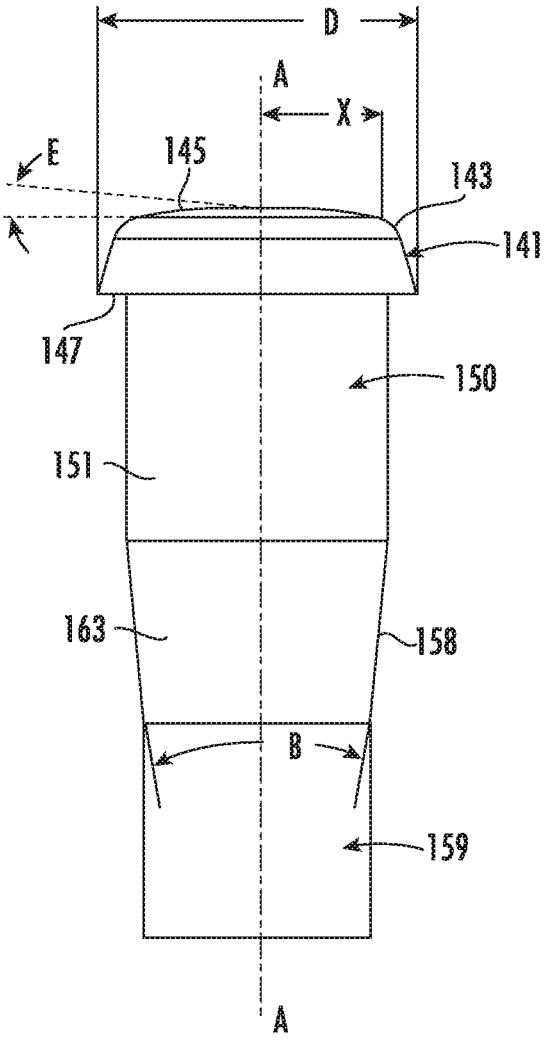
FIG. 11 is an enlarged side view of the tip insert, similar to FIG. 8, showing details of the forward end configuration.

The bullet 41 of FIGS. 4-8, like the bullet 41 shown in FIGS. 1-3, includes a tip insert 141 that is mostly contained within the jacket 51. The tip insert 141 has a forward end tip portion 143 at least partially exposed beyond the meplat 67. The forward end nose tip portion 143 has a forward surface or face 145 that is blunt and also forms an anvil, as described above, for impact with a target. Blunt, for the purposes of this application, means that the distance X on the tip portion 143 (and similarly for tip portion 83), FIG. 11, for purposes of this definition, is 0.75 times the diameter D/2 (or D1/2 for the form shown in FIG. 4) (or the radius of the tip portion 83). The angle E between a transverse plane perpendicular to the axis A-A and a line from a point at the distance X to the center axis AA at the end of the tip portion 143 is less than about 35°, preferably less than about 25°, and most preferably less than about 10°. This means that the face 145, (or face 85 described above) could be slightly contoured, for example, slightly rounded or slightly pointed and convex or concave. The tip portion 143 has a rearwardly facing ledge 147 that is adjacent to the meplat 67 of the jacket 51, and can be in engagement therewith to provide an abutting surface for movement of the tip portion 141 into the hollow forward end of the jacket 51 or, as shown, the ledge 147 can be inside the jacket 51 adjacent the meplat 67, but below flush. Additionally, the ledge 147 is spaced from the leading edge 148 of the core 55. A cup 149 is formed in the forward end of the forward end portion 49. As seen in FIG. 4, the tip insert 141 has a stem portion 150 with a forward portion 151 that is positioned inside the forward end of the jacket 51, which is shown as hollow, and a portion of a pocket 152 in the core 55. The pocket 152 opens into the cup 149 at its rear end.

The forward portion 151 extends into the cup 149 and the forward end portion 49 from the tip portion 143 approximately ¼ to about ¾ of the diameter of the body section 63, exclusive of the cannelure 45, the so-called bullet bore diameter. Preferably, the forward portion 151 of the stem 150 is generally cylindrical along its length. The stem 150 also has a rear portion 158 that is positioned in the pocket 152. As shown, the rear portion 158 has two portions, a leading portion 163 and trailing or terminal end portion 159. The terminal end portion 159 is preferably generally cylindrical along its length and has a generally uniform diameter in transverse cross section. The leading portion 163 has a leading edge 161 followed by a transverse cross section with a decreasing area/size from the leading edge 161 to the terminal end portion 159. The terminal end portion 159 outer surface contour is similar to the contour of the surface defining the closed end portion 164 of the pocket 152, preferably generally round in transverse cross section. The terminal end portion 159 is movable within the pocket 152 for both assembly and during expansion of the bullet 41 when in contact with a target. The tip insert can be held in the bullet 41 by friction and/or adhesive.

The pocket 152 has a shape, along its length, corresponding to the exterior shape of the forward portion 151 and the rear portion 158. Preferably, at least a majority of the exterior surface of the leading portion 163 is in engagement with the surface portion 166 defining the pocket 152 at the locus of the leading portion 163, or closely spaced therefrom on the order of about 0.010" or less. From its beginning at the rear end of the forward portion 151 to the beginning of the forward portion of the terminal end portion 159, the cross-sectional area of the leading portion 163 decreases. This can be accomplished by shaping the leading portion 163 as conical, pyramidal or other suitable shape having a decreasing cross-sectional area from front to rear. The included angle B diverges forwardly and is at least 5°, and is in the range of between 5° and about 45°, and preferably in the range of between about 10° and about 35°. The major cross-sectional dimension of the leading portion 163 at the rear end of the forward portion is on the order of about 70% or more of the inside diameter of the jacket 51 at the longitudinal locus of the forward end of the leading portion 163. The tip insert 141 is preferably made of a polymeric material, including plastic and elastomers, having a hardness in the range of between about 60 and about 95 Shore A as measured by a Durometer test like the tip insert 81.

The leading portion 163 of the rear portion 158, and the rear portion 108 (as illustrated in FIG. 2), because of their size change, form a wedge to help force the core 55 to expand at the leading end thereof to effect bullet expansion.

In a preferred embodiment, the jacket 51, except for the skives 101, and core 55 are symmetrical about a central longitudinal axis A of the bullet 41. Similarly, in a preferred embodiment, the tip inserts 81, 141 are symmetrical about the axis A.

The ballistic coefficient of the bullet 41 is at least about 0.2 when measured at a speed of 950 feet/second (fps) in accordance with industry standards.

Figure 10:
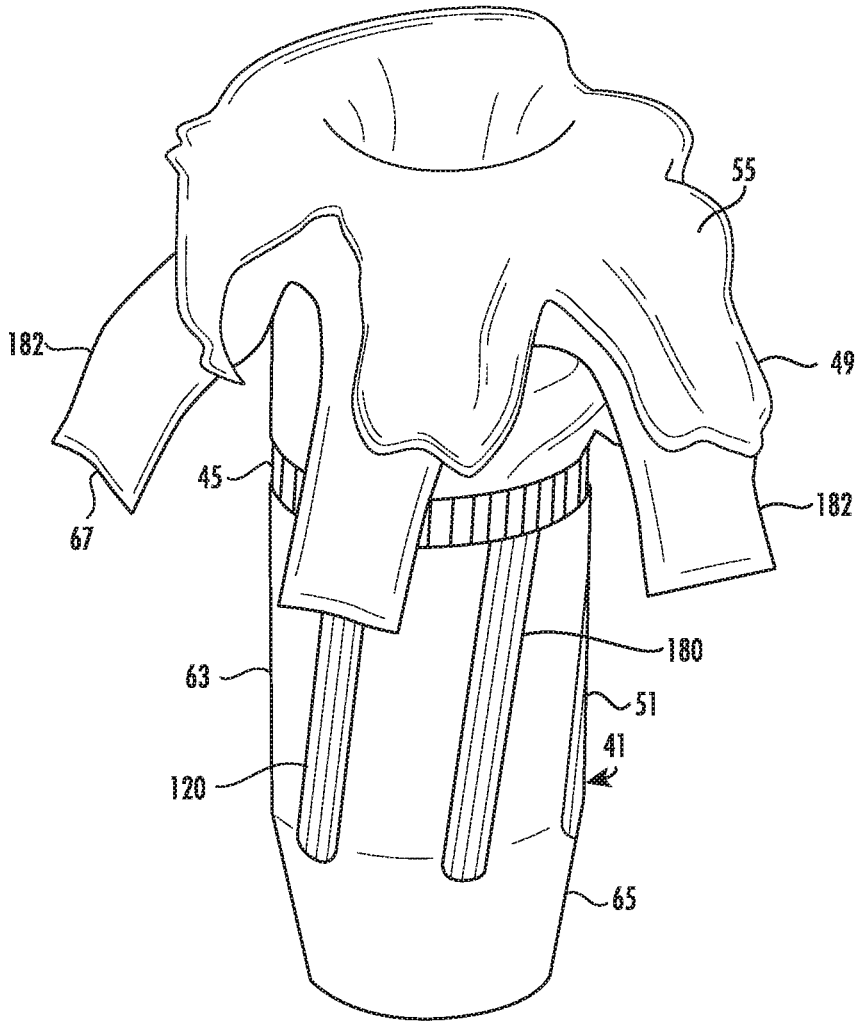
FIG. 10 is a perspective view of a bullet shown expended from impact with a target including first heavy clothing, followed by ballistic gel and having an impact speed of 1027 fps (feet/second)

FIG. 10 represents a photograph of a bullet 41, as shown in FIGS. 4-9, after expansion in a target. The bullet 41 impacted the target at 1027 fps, and the target included first heavy clothing following by ballistic gel. The body 63 now includes indentations 180 from the barrel rifling. The forward end portion 49 is mushroomed out, forming petals 182. The edges of the petals 182 are formed at the skives 101. The core 55 also fractured at the skives 101 and overlies portions of the petals 182.

Orientation terms as used herein, like forward and rearward are used in the sense of the nose portion 49 and meplat 67 being forward and the tail portion 65 being rearward. This also is indicative of the normal direction of travel.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The invention claimed is:

1. A bullet adapted for expansion at subsonic speed comprising:

a tip portion, a body portion and a tail portion, said tip portion having a forward end portion with a meplat and a plurality of longitudinally extending skives spaced circumferentially about the tip portion and extending inwardly from the outer surface of the tip portion;

a pocket at least partially in said tip portion opening toward said meplat and extending rearwardly toward the tail portion; and a tip insert having a nose tip portion and a stem portion, said stem portion being at least partially positioned in said pocket, said stem portion having a rear portion with a first portion of the rear portion having a cross sectional area decreasing in transverse cross sectional size from a leading edge toward a trailing end thereof, said pocket having a portion corresponding in shape to the tip insert rear portion and having at least a portion of the stem rear portion positioned therein, and wherein the nose tip portion of the tip insert has a forward face that, on a majority of said face, is blunt.

2. The bullet of claim 1, including a cup in the tip portion extending inwardly from the meplat and opening onto said meplat, said pocket opening into said cup.

3. The bullet of claim 2, wherein the first portion having an included angle of at least 5° diverging forwardly.

4. The bullet of claim 3, wherein the included angle is in the range of between 5° and about 45°.

5. The bullet of claim 4, wherein the first portion being at least partially generally conical.

6. The bullet of claim 4, wherein at least some of said skives open onto the meplat.

7. The bullet of claim 4, wherein at least some of the skives form ribs extending into said cup.

8. The bullet of claim 7, wherein at least some of said ribs engage a portion of the stem portion.

9. The bullet of claim 5, wherein the tip portion, body portion and tail portion being a monolithic construction.

10. The bullet of claim 5, wherein the bullet is a jacketed bullet having a metal jacket and a metal core, part of said jacket partially forming said cup and said pocket being in said core.

11. The bullet of claim 10, wherein the diameter of a leading edge of the first portion is at least about 70% of an inside diameter of said jacket at a longitudinal locus of said leading edge.

12. The bullet of claim 10, wherein the jacket being made at least partially of copper and said core being made at least partially of lead.

13. The bullet of claim 2, wherein tip insert having a nose tip portion with at least a portion of the nose tip portion extending forwardly of the meplat.

14. The bullet of claim 13, wherein the nose tip portion having a rearwardly facing ledge overlying the meplat.

15. The bullet of claim 13, wherein the nose tip portion having a portion thereof positioned in the cup.

16. The bullet of claim 1, wherein said rear portion of said stem portion having a shape corresponding generally to a shape of said pocket in which said rear portion of said stem portion is positioned.

17. The bullet of claim 1, wherein said bullet having a ballistic coefficient of at least about 0.2 at 950 feet/second.

* * * * *